United States Patent [19]

Mowbray et al.

[11] 4,090,645

[45] May 23, 1978

[54] POWDER METERING SYSTEM

[75] Inventors: Kenneth D. Mowbray, Des Plaines; Kenneth L. Hagen, Addison, both of Ill.

[73] Assignee: Electro Sprayer Systems, Inc., Rosemont, Ill.

[21] Appl. No.: 716,528

[22] Filed: Aug. 23, 1976

[51] Int. Cl.[2] ..... B67D 5/54

[52] U.S. Cl. ..... 222/193; 222/414

[58] Field of Search ..... 222/193, 312, 313, 314, 222/367, 368, 414, 195, 194

[56] References Cited

U.S. PATENT DOCUMENTS

| | | | |
|---|---|---|---|
| 3,190,506 | 6/1965 | Selzler | 222/314 |
| 3,223,288 | 12/1965 | Stern | 222/194 |
| 3,490,654 | 1/1970 | Fischer | 222/193 |
| 3,616,972 | 11/1971 | Christy | 222/414 X |
| 3,995,775 | 12/1976 | Birkmeier et al. | 222/193 |
| 4,013,196 | 3/1977 | Hines | 222/414 X |

*Primary Examiner*—Stanley H. Tollberg
*Attorney, Agent, or Firm*—McDougall, Hersh & Scott

[57] ABSTRACT

A system for distributing powder which is stored in a hopper and delivered from the hopper to distributing nozzles. A metering construction is interposed between the hopper and the distributing nozzles, this construction comprising a roller which receives powder from the hopper. The roller carries powder at a controlled rate to a passage where the powder is exposed to a pressurized fluid such as air. The powder is moved with the fluid to the distributing nozzles. Separate inlets, preferably for the introduction of air at atmospheric pressure, communicate with the passage. The distributing nozzles are designed for the distribution of the powder evenly over wide sheets of paper, foil or plastic, and over the printed surfaces of a web of paper or plastic.

11 Claims, 13 Drawing Figures

POWDER METERING SYSTEM

This invention is directed to constructions for the handling of powder and, in particular, to constructions which serve to deliver powder in a carefully controlled fashion. The invention is particularly usable in operations which involve the application of powder to the printed surfaces of sheets of paper or plastic and the like.

Electrostatic powder sprayers are widely employed as a means for applying anti-offset powders to the printed surfaces of sheets, webs and the like. Such application of powders takes place after printed material emerges from a printing press.

Powder utilized in such operations typically comprises a random mixture ranging in size from 5 to 100 microns. Because of the size of the particles involved, numerous problems have developed when attempting to uniformly distribute th powder over a sufficiently long period of time to provide an efficient operation. The small particle size coupled with the size range involved, results in a material which cannot be handled on a predictable basis with systems currently available for use.

One attempt to solve the handling problems involved the use of a carburetor which fluidized powder in a jar-like container with the powder being contained in a rapidly moving air stream for movement to distributing means. Such systems utilize a needle valve or the like for increasing or decreasing the introduction of fluidizing air, and the air flow is continuously interrupted to provide for agitation of the powder. This arrangement leads to the removal of the smaller particles in the size range during the early stages of operation leading eventually to the presence of only the coarser fraction of the material for distribution. This necessitates continuing changes in operating conditions in order to maintain uniformity.

An alternative system utilizes a vibrator for sifting powder into a receiver where the powder is picked up by an air stream. It has been found, however, that the vibration of the powder results in packing and clogging. Futhermore, the necessity for agitation limits the size of such systems. Difficulties in providing uniformity are also experienced so that constant attention to flow control is required.

Another system utilizes a long fountain-type powder hopper placed across the path which the sheets must pass on the way to the delivery pile, and this system is an improvement. Typically, the system employs a textured or engraved roller upon which powder is metered by using a steel or plastic blade in contact tangentially with the roller. This provides an even coating of powder which is carried out of the hopper into an alternating high voltage field generated by a neon static tube. The powder particles are blasted off the roller surface and then fall, sometimes assisted by a gently flowing curtain of air, to the sheets. The degree of powder application is controlled by varying the speed of the roller.

In this system, the hopper, blade, roller and tube must extend across the entire width of the press, as close to the sheets as possible, and in the correct position. The result is that filling of the hopper requires shutting down the machinery, and a man then ladles powder into the hopper. This is not easily done on some machines.

Automatic filler equipment has been proposed for feeding powder into such hoppers. This equipment is limited in application to systems where nearly straight line access is available at the end of the hopper, from outside the press frames. This sometimes results in awkward or impossible placement of the filler hopper. In any event, the system has not proven reliable enough to receive general acceptance.

The system of this invention is designed to overcome the problems experienced with prior art systems. This invention provides for large capacity as well as great uniformity of operation so that the attention necessary for insuring uniform powder distribution is greatly reduced.

It is, accordingly, the principle object of this invention to provide a powder distributing system which is characterized by a control arrangement which permits the distribution of powder onto printed sheets and the like in a highly efficient manner.

It is a more specific object of this invention to provide a system of the type described which is characterized by a metering arrangement for the powder including unique means for delivering the powder to nozzle constructions, whereby the mechanism of the invention substantially eliminates problems characterizing prior art systems.

These and other objects of this invention will appear hereinafter and for purposes of illustration, but not of limitation, specific embodiments of the invention are shown in the accompanying drawings in which.

Figure 5:
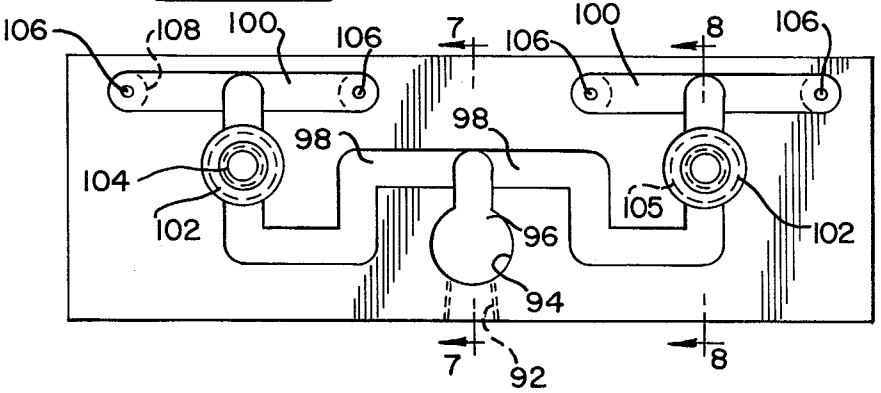
Figure 6:
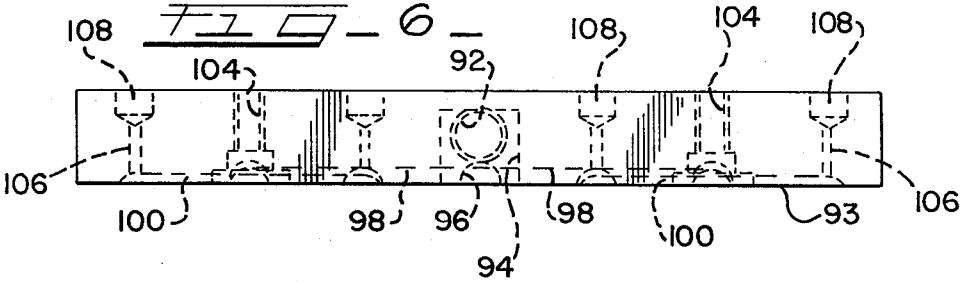
Figure 10:
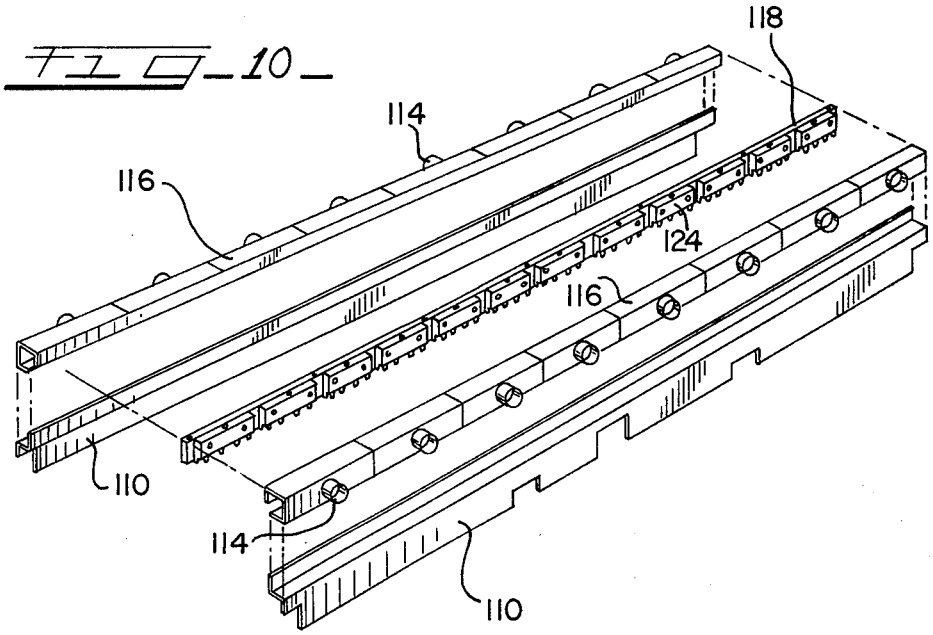
Figure 11:
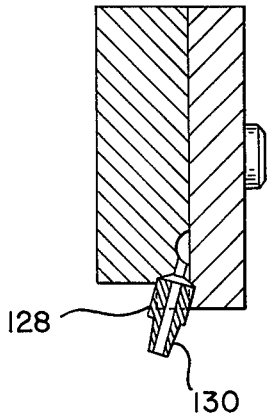
Figure 4:
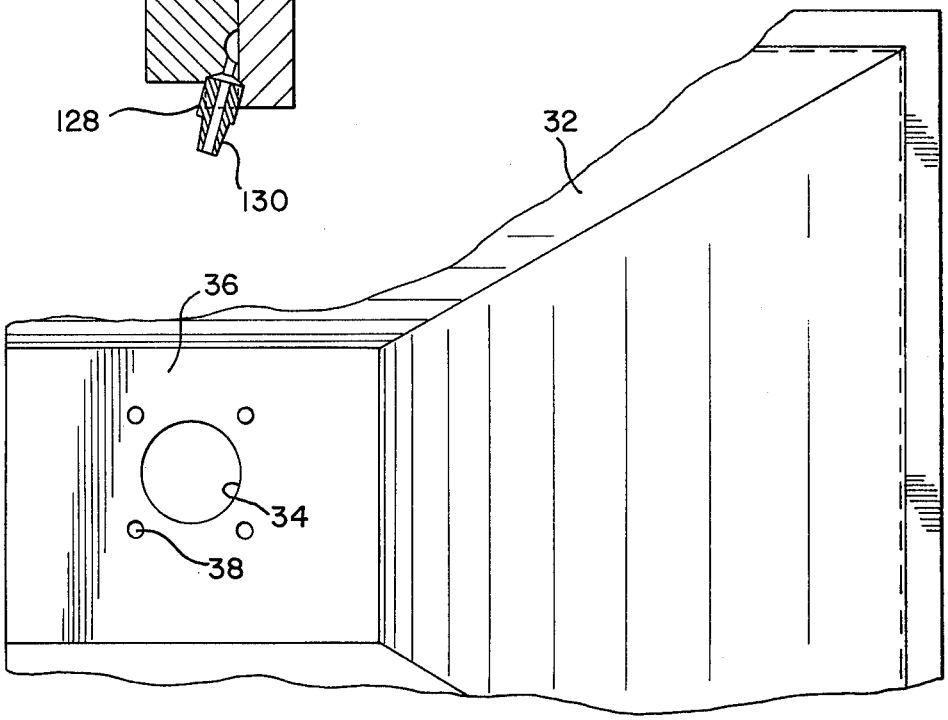
Figure 9:
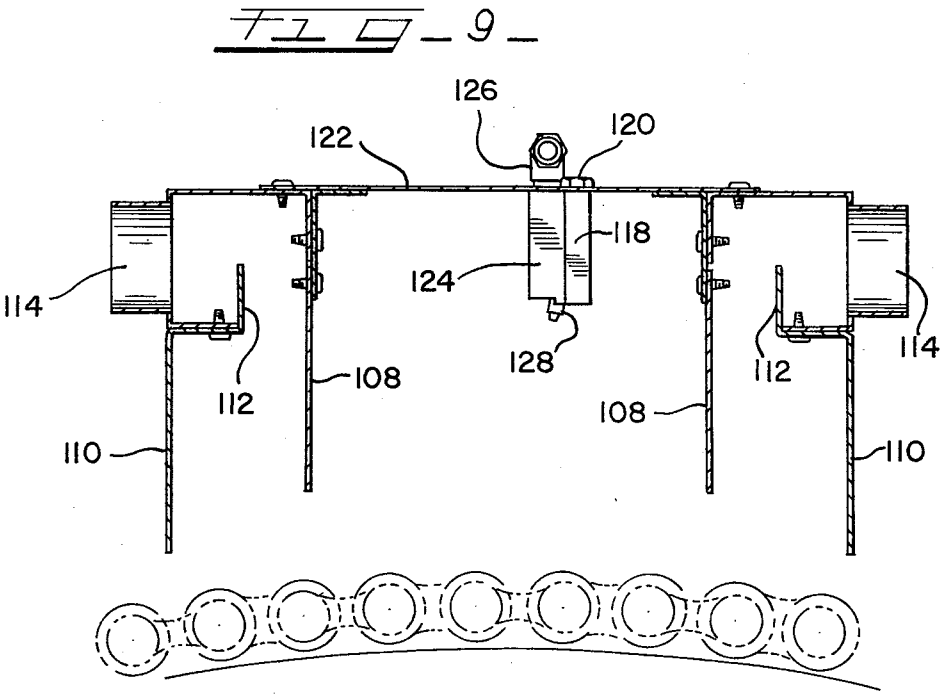
Figure 7:
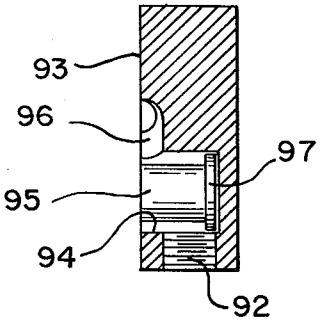
Figure 8:
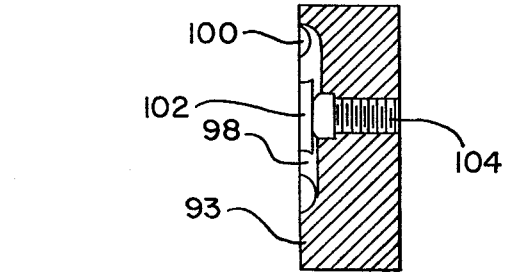

FIG. **3*a*** is a detail view illustrating doctor blades utilized in conjunction with a metering roller;

FIG. **3*b*** is a detailed view illustrating an alternative form of a powder metering structure;

FIG. 4 is a bottom view, partly cut away, illustrating the hopper construction utilized with the system of the invention;

FIG. 5 is a plan view of a nozzle body construction utilized in the system;

FIG. 6 is a top view of the body shown in FIG. 5;

FIG. 7 is a cross-sectional view taken about the line 7—7 of FIG. 5;

FIG. 8 is a cross-sectional view taken about the line 8—8 of FIG. 5;

FIG. 9 is a cross-sectional view illustrating an alternative form of a nozzle assembly in association with a construction for applying powder;

FIG. 10 is a perspective view of the alternative structure shown in FIG. 9; and, FIG. 11 is an enlarged cross-sectional view illustrating the design of a nozzle assembly utilized in the alternative arrangement of FIGS. 9 and 10.

The construction of this invention involves a system for distributing powder wherein the powder is stored in a hopper and delivered to distributing means for the application of the powder to printed surfaces or for similar purposes. One aspect of the invention relates to metering means which are interposed between the hopper and the distributor. The metering means comprise a roller, and means are employed for maintaining a substantially constant amount of powder on the roller surface. A doctor blade structure is preferably utilized for this purpose.

In accordance with the preferred form of the invention, a source of compressed air is introduced into a passage which communicates with the roller surface. As the roller introduces powder into the vicinity of the passage, the compressed air picks up the powder for movement to the distributing means.

The preferred form of the invention further includes one or more secondary air inlet openings into the passage. These secondary openings supply air or other fluid which is maintained at a pressure, such as ambient pressure, which is lower than the pressure of the compressed air. The low-pressure fluid is introduced in response to negative pressure conditions which are developed within the passage.

The invention also utilizes a manifold system whereby the powder-fluid mixture in the passage is divided. Specifically, a manifold is employed for directing the mixture into separate flexible hoses, and these hoses are connected to nozzle units. Each nozzle units includes a plurality of openings, and nozzle heads defining distribution orifices are attached at these openings. The nozzle heads direct the powder-fluid mixture onto the printed web or the like which is running through the system.

Figure 1:
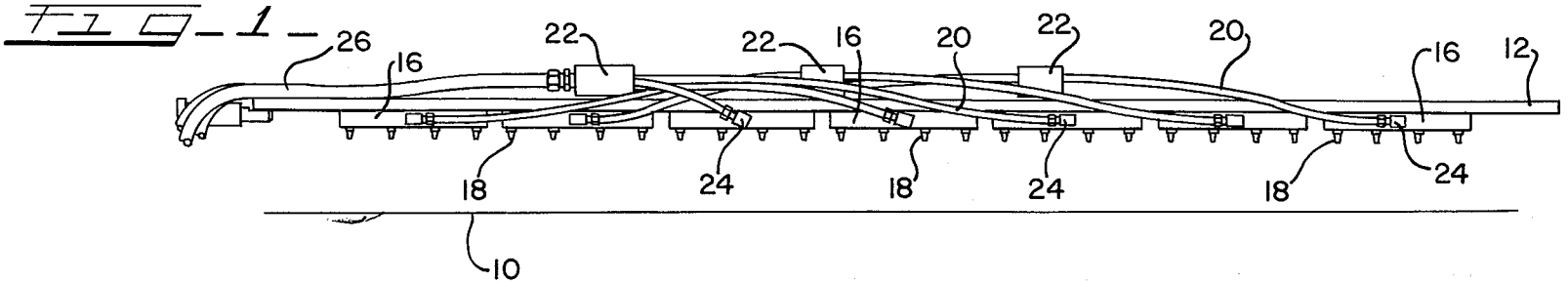
FIG. 1 is a vertical elevational view of a powder distributing construction characterized by the features of this invention.

The accompanying drawings illustrate in detail the concepts of the invention. Referring to FIG. 1, a web or sheet 10 which is to be exposed to powder is positioned below an assembly employed for delivering powder to the web surface. This assembly includes a mounting bar 12 supported at its ends by any suitable means. The mounting bar carries a plurality of nozzle units 16. Each nozzle unit carries four nozzle heads 18.

Flexible hoses 20 extend from intermediate manifolds 22 to fittings 24 associated with each nozzle unit 16. As noted, three intermediate manifolds 22 are utilized in conjunction with seven nozzle units 16. In the embodiment illustrated, the right-hand manifold 22 directs a fluidpowder mixture to two nozzle units 16, one at each end of the bar 12, while the other two manifolds direct the mixture to the remaining five nozzle units. Many variations in the arrangement of these structures are available.

As shown in the illustrated example, three flexible hoses 26 are utilized for feeding the mixture to the intermediate manifolds 22. The hoses 26 are connected to a main manifold 28 shown in FIG. 3. A pipe 30 is connected to the manifold 28 for feeding the mixture to this manifold.

One of the hoses 26 is utilized for directing the mixture to the right-hand manifold 22, and a valve (not shown) associated with the manifold 28 is utilized for controlling the delivery of the mixture to this manifold 22. Accordingly, by shutting off this valve, the two end nozzle units 16 are deactivated so that powder will not be dispensed when a sheet or web of lesser width is moving through the equipment. A second on-off valve for the manifold 28 will be provided for controlling delivery through a second hose 26 to thereby control movement of mixture to a separate manifold 22 thereby permitting the deactivation of additional nozzle units 16. Preferably, the two nozzle units spaced inwardly from the end units will be so-controlled. In a typical system, a nozzle unit 16 will spray six inches of surface area so that closing of the first mentioned valve will cut off six inches of spraying at each end, while closing of the second mentioned valve will cut off an additional six inches from each end. With this system, selectively for minimizing waste is provided in a highly efficient fashion.

Figure 3A:
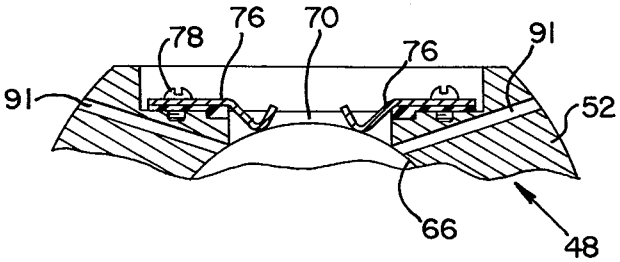
FIG. 3 is a cross-sectional view of the metering arrangement taken about the line 3—3 of FIG. 2.
Figure 3B:
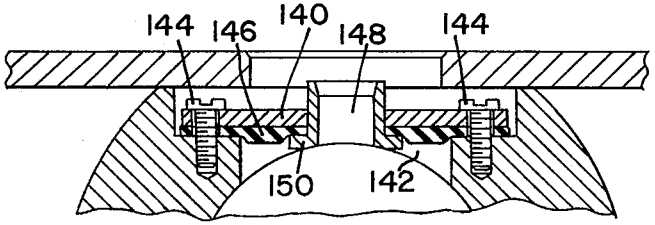
Figure 2:
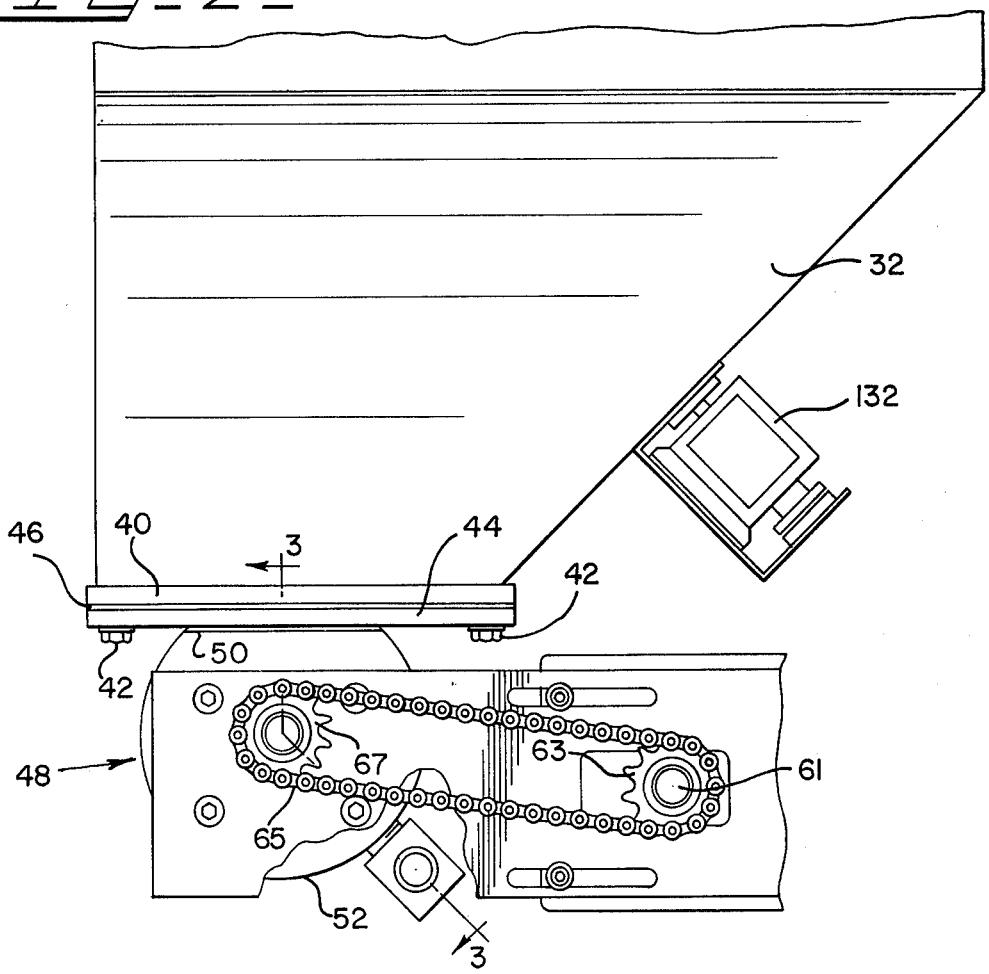
FIG. 2 is an elevational view, partly cut away, illustrating a powder metering arrangement utilized in accordance with this invention.
Figure 3:
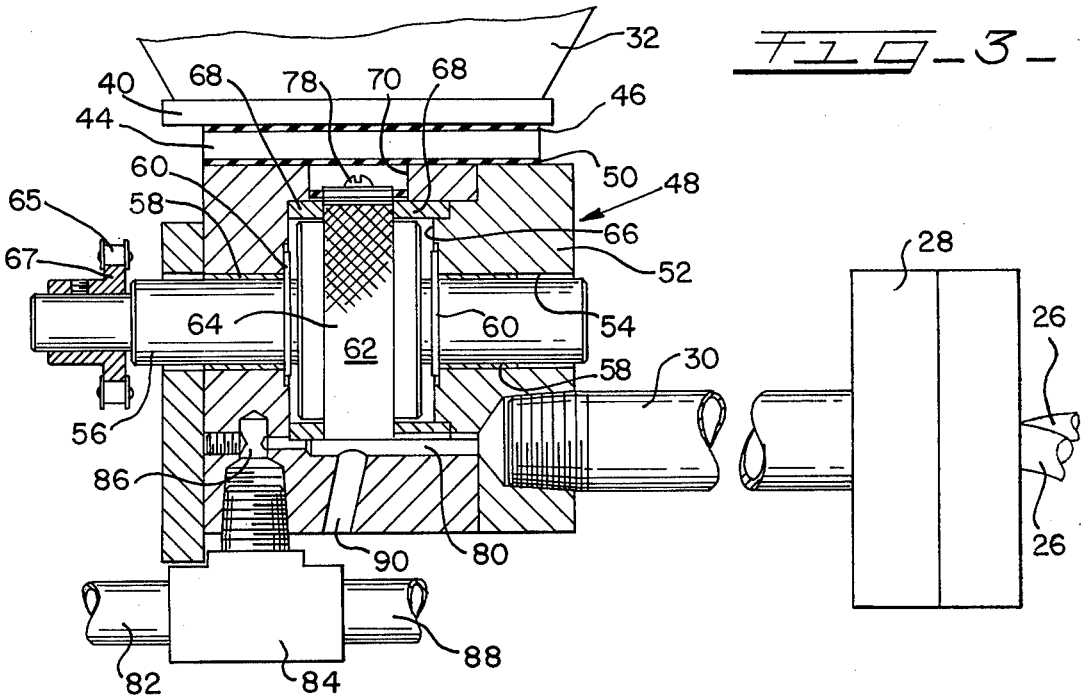

As best shown in FIGS. 2, 3 and 4, the powder employed for forming the mixture is stored in a hopper 32. This hopper tapers downwardly to a discharge end, defining a discharge opening 34, and means for metering powder discharged from the hopper are located in this position.

The opening 34 is defined in a bottom wall 36 of the hopper, and a plurality of openings 38 are provided for attaching a plate 40 to the hopper. The plate 40 in turn defines openings for receiving bolts 42 which serve to attach a second plate 44. A gasket 46 is preferably interposed between the plates 40 and 44 to avoid seepage of powder from between the plates.

The plate 44 serves as a means for supporting metering units 48. This metering unit is attached to the plate by fasteners (not shown), and a gasket 50 is again utilized to provide a seal at this joint.

The metering unit 48 consists of a cylindrical housing 52, the housing defining a horizontal bore 54 for receiving shaft 56. Bearings 58 defining flanges 60 are provided in the bore 54.

A motor (not shown) is provided, the motor having a driving shaft 61 and an associated sprocket 63. The chain 65 extends to sprocket 67 which is tied to the shaft 56. The motor utilized is preferably a gear motor adapted to run efficiently at variable speeds. A metering roller 62 on the shaft 56 defines an engraved surface area 64. This may be a two-piece unit with the roller tied to the shaft or the combination may be machined from one piece.

A typical roller comprises a No. 17 Quadqravure roller produced by Pamarco. It will be understood, however, that a variety of engraved, knurled or etched roller surfaces are contemplated since this is only one variable to be considered when determining the feed rate. Roller width, diameter and speed are also factors which can be varied for purposes of controlling the feed rate. Furthermore, different feed rates are contemplated, depending upon the particular application involved with a typical setup involving a twoinch diameter, $\frac{5}{8}$ inch wide roller rotating at 80 RPM delivering 5 pounds of powder per hour. The same roller running at speeds as low as one RPM will deliver in the order of $\frac{1}{4}$ pound per hour.

The roller is positioned within a cavity 66 defined by the housing 52. A pair of sealing sleeves 68 are positioned within this cavity so that the inner edges of these sleeves are positioned immediately adjacent the side walls of the engraved roller portion 64, this arrangement being provided for avoiding passage of powder into the cavity 66. The various seals referred to herein may be formed of tetrafluoro ethylene, for example, as marketed under the name Teflon by du Pont, or similar materials which have good wear resistance and sealing qualities.

The upper portion of the housing 52 defines a chamber 70 communicating with the opening 34 in the bottom wall of the hopper 32 and with aligned openings in plates 40 and 44. As best illustrated in FIG. 3*a*, a pair of doctor blades 76 are positioned in the chamber 70, and immediately adjacent the periphery of the engraved portion 64 of the roller 62. The doctor blades define slots, and screws 78 are utilized for adjustably positioning these blades whereby the pressure between the blade surfaces and the roller periphery can be varied.

The cylindrical housing 52 defines a passage 80 which is exposed to the roller portion 64. A pressurized fluid inlet pipe 82 is connected to fitting 84 which includes internal passages for directing the fluid to inlet port 86 which communicates with the passage 80. A second line 88 associated with the fitting 84 is connected to a pressure gauge whereby the pressure of the fluid directed into the passage 80 may be monitored. Air is a satisfactory fluid for utilization in this system; however, other fluids are contemplated.

A secondary air port 90 has its inner end communicating with the passage 80 and, in the embodiment illustrated, its outer end communicates with the atmosphere. The provision of this port results in the introduction of air into the passage 80 over and above the compressed air entering through the port 86. Additional secondary air ports 91 (FIG. 3*a*) may be utilized for introducing air into the cavity 66.

FIG. 3*b* illustrates an alternative arrangement for controlling the movement of powder onto the roller 62. This structure includes a plate 140 held in position to span the passage 142 by means of screws 144. A gasket 146 is positioned on the underside of the plate 140 to prevent all powder leakage from around the periphery of the plate.

The central opening defined by the plate receives a metering shoe 148, and the gasket 146 extends between the underside of the plate and flange 150 formed on the shoe. Accordingly, leakage between the adjoining surfaces of the plate and shoe is eliminated. The bore defined by the shoe thus provides the sole avenue for movement of powder onto the roller surface, and the size of this bore can be varied as one means for controlling the rate of powder delivery.

As with the doctor blades of FIG. 3*a*, the metering shoe is adapted to be fit snugly against the surface of roller 62. Since this surface is engraved, the provision is made for the carrying of powder by the roll beneath the edges of the shoe. In order to minimize maintenance, the shoe is preferably formed of a wear-resistant material such as nylon or Delryn.

FIGS. 5 through 8 illustrate details of a nozzle unit 16 which may be utilized in the practice of the invention. As shown in FIG. 1, these nozzle units are attached to support bar 12, and any suitable fasteners may be utilized for this purpose.

The fittings 24 for each nozzle unit are connected at the threaded openings 92 shown in FIG. 7. The fluid-powder mixture which enters the nozzle units is received within circular chamber 94, it being understood that the inner face 93 of the nozzle unit is held tightly against the surface of supporting bar 12 whereby the mixture in the chamber 94 is confined.

The chamber 94 has an outlet passage 96 and branch passages 98 communicating therewith. The branch passages extend to end portions 100 beyond chambers 102. The chambers 102 are utilized for equalizing the powder flow to both of the branch passages. The threaded openings 104 shown in FIGS. 6 and 8 provide a means for attaching the fasteners that hold the nozzle 16 to the bar 12.

As best shown in FIG. 7, a plug 95 defining a flange 97 is press fit into the chamber 94 whereby the air and powder mixture entering through opening 92 is split and flows around the sides of the plug. At the exit end of the chamber 94, the separate streams are rejoined, and turbulence results whereby an increased mixing tendency is developed.

The fastener elements threaded into the openings 104 define shoulders which develop a similar mixing in this area. The extent of these shoulders relative to the chambers 102 is shown in dotted lines at 105 in FIG. 5. It is to be understood that the mixing concepts achieved by the plug and fastener arrangement is not a part of this invention.

The portions 100 of the branch passages 98 communicate with small diameter openings 106 with these openings extending to bores 108. Nozzle heads 18 are adapted to be pressed into these openings 108 whereby the fluid-powder mixture is directed to a sheet or web of material moving adjacent to the nozzle heads.

FIGS. 9–11 illustrate a form of the invention which includes means for collecting excess powder from areas adjacent the fluid-powder distributing means. This arrangement includes inner walls 108 and outer walls 110 which serve as collecting areas for excess powder. Baffle elements 112 are located within these chambers to minimize the collection of powder directly from the distributing nozzles and before the powder has more permanently associated itself with the web or sheet being sprayed. Exhaust openings 114 are positioned beyond the baffles 112, and these openings may be connected to any suitable evacuating source. As best shown in FIG. 10, the excess powder collecting structures 116 are preferably in modular form so that such structures can be readily added or replaced in the system. In addition, the number of structures in use can be readily varied as the width of a web or sheet is varied.

FIGS. 9–11 also illustrate a modified form of nozzle means. In this embodiment, the nozzle supporting bar 118 is attached by means of bolts 120 to the transverse wall 122. The nozzle units 124 are attached to the supporting bar at spaced intervals along its length. A fitting 126 is associated with each nozzle unit for purposes of introducing the fluid-powder mixture into the nozzle unit.

The nozzle heads 128 are attached by press fitting of the heads into position. It is also contemplated that the nozzle heads be threaded into position.

It will be noted that each nozzle head is provided with a cone-shaped extension 130. It has been found that this head design more effectively delivers the powder-fluid mixture, and at the same time, the extended design avoids build-up of powder on the surfaces of the supporting bar and the nozzle units.

The construction of this invention provides for the efficient distribution of powder onto the surfaces of moving webs. The hopper 32 utilized in the construction may comprise a large hopper, typically a 25-pound capacity hopper. Accordingly, the system has advantages over prior systems which required the use of substantially smaller sources of powder supply.

In handling the powder, it is not necessary to provide an interrupted flow of air or any extensive equipment for purposes of agitating the powder as a part of or prior to the powder feeding operation. FIG. 2 illustrates a solenoid operated device 132 utilized for bumping the hopper at regular intervals to maintain the powder in the hopper at a reasonably constant level. This action generally takes place every one to five seconds, and is fully sufficient for purposes of insuring continuous flow of powder to the metering construction located at the bottom of the hopper.

As noted, the system utilizes a gear motor drive for the metering roller 62 whereby readily controlled roller speed is maintained. The utilization of the doctor blades coupled with the regulated speed of the roller 62 provides a highly uniform powder distribution over the surfaces of sheets being treated. In this connection, particle separation which occurs during use of fluidizing or vibrating is not a factor in the system described. The powder fed into contact with the metering roll is always from the bottom of hopper 32 and will be essentially uniform in size composition during operation of the system.

It will be appreciated that the flow of fluid into the passage 80 through port 86 is maintained constant, for example, at a rate in the order of four to four and one-half cubic feet per minute. The uniformity of operation is enhanced by the use of the inlet port 90 since this serves as a means for equalizing air pressure in the passage 80. More specifically, the introduction of compressed air through port 86 develops a venturi effect in the passage 80. Air is, therefore, fed into the passage through the secondary air hole 90, and a balance of pressure is maintained. This, in particular, prevents the problem of siphoning while also serving to increase the total volume of air carried with the powder.

As noted, additional air ports 91 communicate atmospheric air with the chamber cavity 66 which receives roller 64. These additional air ports also serve to equalize air pressure thereby stabilizing the rate of delivery of powder by the roller 64.

In a typical system, four nozzle units may be attached to a supporting bar; however, on a large 60-inch press, 10 such units have been utilized. This results in 40 nozzle outlets spaced approximately one and one-half inches apart. As discussed, the manifold structures employed preferably have means for cutting off one or more of the nozzle heads mounted on a nozzle supporting bar. Thus, in a 60-inch system involving 10 nozzle heads, it may be desirable to run webs or sheets of smaller than normal width. As noted, the manifold 28 includes valves, and by turning off one or more of the nozzle openings through operation of the valves, the powder dispensing can be selectively controlled. Similarly, it is contemplated that the manifold structures 22 include means for selectively distributing the powder.

With reference to the metering roller, the face width of the roller, the degree of engraving, and the speed of operation, will all effect the rate of delivery of powder to the passage 80. Accordingly, means are readily available for controlling the flow rate without affecting the basic principles of operation.

The ability to maintain continuous and uniform feed provides for extremely uniform powder distribution on the web or sheets being handled. This uniformity is particularly true from edge-to-edge of the sheet or web since the various manifold controls utilized in the system provide for flow of material from the nozzle head uniformly irrespective of the nozzle head position along the length of the supporting bar.

The uniform flow also minimizes build-up of material in pipes, tubes and the like. Furthermore, there is no necessity for locating the powder supply hopper in the immediate vicinity of the distributing nozzles. The hopper can be located in any convenient place without in any way affecting the uniformity of the powder distribution.

It will be understood that the powder spraying system described above can be modified in various ways without departing from the spirit of the invention particularly as defined in the following claims.

That which is claimed is:

1. In a system for distributing powder wherein the powder is stored in a hopper and delivered from the hopper to distributing means, the improvement comprising metering means interposed between said hopper and said distributing means, said metering means comprising a housing, a roller mounted on a horizontal axis, a cavity defined within said housing receiving said roller, the interior surface of said cavity and the opposing roller periphery defining a channel for confining powder carried by the roller, and sealing means adjacent the periphery of said roller for defining the sides of said channel, said hopper defining a bottom discharge opening positioned immediately adjacent the upper moving surface of said roller, means for delivering powder from the hopper into contact with the roller, said roller thereby carrying metered amounts of the powder away from the hopper, a passage located in communication with the roller periphery adjacent the bottom moving surface of said roller substantially opposite the position of delivery of the powder from the hopper, said passage extending away from said roller to said distributing means, inlet means for said passage, a source of compressed fluid connected to said inlet means, means for applying said compressed fluid to said roller whereby said powder is picked up from the hopper, said passage extending away from said roller to said distributing means, inlet means for said passage, a source of compressed fluid connected to said inlet means, means for applying said compressed fluid to said roller whereby said powder is picked up from the roller by the fluid and moved with the fluid through said passage to said distributing means, drive means for said roller, and means for varying the speed of said drive means for controlling the rate of movement of said powder into said passage and to said distributing means.

2. A system in accordance with claim 1 wherein said compressed fluid and said lower pressure fluid comprise air, said additional inlet being open to the atmosphere.

3. A system in accordance with claim 1 including a pair of doctor blades positioned adjacent said roller on opposite sides of said discharge opening for defining the area of the roller receiving powder from the hopper and for controlling the rate of powder movement from said roller to said passage.

4. A system in accordance with claim 1 wherein said passage extends horizontally, said additional inlet defining an opening into said passage directly opposite said bottom surface.

5. A system in accordance with claim 1 wherein said roller is engraved to facilitate retention of powder thereon.

6. In a system for distributing powder wherein the powder is stored in a hopper and delivered from the hopper to distributing means, the improvement comprising metering means interposed between said hopper and said distributing means, said metering means comprising a housing, a roller mounted on a horizontal axis, a cavity defined within said housing receiving said roller, the interior surface of said cavity and the opposing roller periphery defining a channel for confining the powder carried by the roller, and sealing means adjacent the periphery of said roller for defining the sides of said channel, said hopper defining a bottom discharge opening positioned immediately adjacent the upper moving surface of said roller, means for delivering powder from the hopper into contact with the roller, said roller thereby carrying metered amounts of the powder away from the hopper, a passage located in communication with the roller periphery adjacent the bottom moving surface of said roller substantially opposite the position of delivery of the powder from the hopper, said passage extending away from said roller to said distributing means, inlet means for said passage, a source of compressed fluid connected to said inlet means, means for applying said compressed fluid to said roller whereby said powder is picked up from the roller by the fluid and moved with the fluid through said passage to said distributing means, drive means for said roller, and means for varying the speed of said drive means for controlling the rate of movement of said powder into said passage and to said distributing means.

7. A system in accordance with claim 6 including at least one doctor blade positioned adjacent said roller for further controlling the rate of powder movement from said roller to said passage.

8. A system in accordance with claim 6 wherein said roller is engraved to facilitate retention of powder thereon.

9. In a system for distributing powder wherein the powder is stored in a hopper and delivered from the hopper to distributing means, the improvement comprising metering means interposed between said hopper and said distributing means, said metering means comprising a roller mounted on a horizontal axis, said hopper defining a bottom discharge opening positioned immediately adjacent the upper moving surface of said roller, means for delivering powder from the hopper into contact with the roller, said roller thereby carrying metered amounts of the powder away from the hopper, a passage located in communication with the roller periphery adjacent the bottom moving surface of said roller substantially opposite the position of delivery of the powder from the hopper, said passage extending away from said roller to said distributing means, inlet means for said passage, a source of compressed fluid connected to said inlet means, means for applying said compressed fluid to said roller whereby said powder is picked up from the roller by the fluid and moved with the fluid through said passage to said distributing means, and including at least one additional inlet for said passage, a source of fluid maintained at a pressure lower than said compressed fluid and connected to said additional inlet, said lower pressure fluid being drawn into said passage through said additional inlet in response to negative pressure conditions which are developed within the passage, and wherein said distributing means includes a plurality of independent nozzle structures defining inlet means for receiving said powder and outlet means connected thereto, said outlet means including tubular extensions defining orifices through which the powder passes outwardly of the nozzle structures.

10. A system in accordance with claim 9 wherein said tubular extensions are cone-shaped to thereby prevent build-up of powder on said nozzle structures.

11. A system in accordance with claim 9 wherein said distributing means is utilized for applying powder to the surface of a printed sheet, and including means for selectively directing said powder to said nozzle structures depending upon the width of said sheet.

* * * * *